US009513051B2

(12) United States Patent
Tasaka

(10) Patent No.: US 9,513,051 B2
(45) Date of Patent: Dec. 6, 2016

(54) METHOD FOR RECOVERING HYDROCARBON COMPOUNDS AND A HYDROCARBON RECOVERY APPARATUS FROM A GASEOUS BY-PRODUCT

(71) Applicants: Japan Oil, Gas and Metals National Corporation, Tokyo (JP); INPEX Corporation, Tokyo (JP); JX Nippon Oil & Energy Corporation, Tokyo (JP); Japan Petroleum Exploration Co., Ltd., Tokyo (JP); Cosmo Oil Co., Ltd., Tokyo (JP); Nippon Steel & Sumikin Engineering Co., Ltd., Tokyo (JP)

(72) Inventor: Kazuhiko Tasaka, Tokyo (JP)

(73) Assignees: JAPAN OIL, GAS AND METALS NATIONAL CORPORATION, Tokyo (JP); INPEX CORPORATION, Tokyo (JP); JX NIPPON OIL & ENERGY CORPORATION, Tokyo (JP); JAPAN PETROLEUM EXPLORATION CO., LTD., Tokyo (JP); COSMO OIL CO., LTD., Tokyo (JP); NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 14/251,816

(22) Filed: Apr. 14, 2014

(65) Prior Publication Data

US 2014/0250946 A1 Sep. 11, 2014

Related U.S. Application Data

(62) Division of application No. 13/138,471, filed as application No. PCT/JP2010/001145 on Feb. 22, 2010, now Pat. No. 8,729,142.

(30) Foreign Application Priority Data

Feb. 27, 2009 (JP) ..... 2009-046150

(51) Int. Cl.
*F25J 3/08* (2006.01)
*C10G 2/00* (2006.01)
*C10G 31/06* (2006.01)

(52) U.S. Cl.
CPC .. *F25J 3/08* (2013.01); *C10G 2/30* (2013.01); *C10G 31/06* (2013.01); *C10G 2300/1022* (2013.01); *C10G 2300/4081* (2013.01)

(58) Field of Classification Search
CPC ..... F25J 3/08
USPC ..... 422/234
See application file for complete search history.

(56) References Cited

U.S. PATENT DOCUMENTS 2,514,340 A 7/1950 Rupp
3,276,674 A * 10/1966 Hens ..... 415/1

(Continued)

FOREIGN PATENT DOCUMENTS

AU 2007232928 10/2007
CN 1611565 5/2005

(Continued)

OTHER PUBLICATIONS

Examination Report dated May 21, 2014 issued in Gulf Cooperation Council Patent Application No. 2010-15335.

(Continued)

*Primary Examiner* — Huy-Tram Nguyen
(74) *Attorney, Agent, or Firm* — Andrews Kurth Kenyon LLP

(57) ABSTRACT

There is provided a method for recovering hydrocarbon compounds from a gaseous by-products generated in the Fisher-Tropsch synthesis reaction, the method comprising a pressurizing step in which the gaseous by-products are pressurized, a cooling step in which the pressurized gaseous by-products are pressurized to liquefy hydrocarbon compounds in the gaseous by-products, and a separating step in which the hydrocarbon compounds liquefied in the cooling step are separated from the remaining gaseous by-products.

1 Claim, 3 Drawing Sheets

(56) References Cited

U.S. PATENT DOCUMENTS

| | | | | |
|---|---|---|---|---|
| 4,475,347 | A | 10/1984 | Hegarty et al. | |
| 5,733,941 | A * | 3/1998 | Waycuilis | C01B 3/382 252/373 |
| 5,776,988 | A | 7/1998 | Chaumette et al. | |
| 2003/0083390 | A1 | 5/2003 | Shah et al. | |
| 2004/0044090 | A1 | 3/2004 | Font Freide et al. | |
| 2006/0131218 | A1 | 6/2006 | Patel | |
| 2008/0096985 | A1 | 4/2008 | Minta et al. | |

FOREIGN PATENT DOCUMENTS

| | | |
|---|---|---|
| CN | 101268325 | 9/2008 |
| JP | 2004-323626 | 11/2004 |
| RU | 2151981 | 6/2000 |
| RU | 2233411 | 7/2004 |
| WO | WO 02/38699 | 5/2002 |
| WO | WO 2007/114279 | 10/2007 |
| WO | WO 2009/013664 | 1/2009 |

OTHER PUBLICATIONS

International Search Report dated Mar. 9, 2010 issued in corresponding PCT Application No. PCT/JP2010/001145.

Kagaku Daijiten 2 reduced-size edition, Kyoritsu Shuppan Co., Ltd., Aug. 15, 1989, reduced-size edition, 32nd print, p. 847, paragraph of 'Gyoshuku' (as cited in the International Search Report).

European Search Report dated Jun. 6, 2012 issued in corresponding European Application No. EP 10745949.7.

Eurasian Office Action dated Apr. 1, 2013 issued in corresponding Eurasian Application No. EA 201170973 [with English translation].

European Office Action dated Apr. 12, 2013 issued in corresponding European Application No. EP 10745949.7.

Chinese Office Action dated Jun. 5, 2013 issued in corresponding Chinese Application No. CN 201080009368.4 [with English Translation].

Notice of Opposition dated May 19, 2015 issued in corresponding EP Application No. 10745949.7.

Coulson and Richardson's Chemical Engineering, vol. 6 (Design), Second Edition, R. K. Sinnott, Pcrgamon Press, 1993, Chapter 3, (1 page).

Perry's Chemical Engineers' Handbook, 7th Edition, R. H. Perry and D. w. Green (Eds.), McGraw• Hill, 1997, Chapter 23, (1 page).

Studies in Surface Science and Catalysis, vol. 152, Fischer-Tropsch Technology, A. P. Steynberg and M. E. Dry (Eds.), Elsevier, 2004, (pp. 108, 421 and 596) (3 pages).

* cited by examiner

METHOD FOR RECOVERING HYDROCARBON COMPOUNDS AND A HYDROCARBON RECOVERY APPARATUS FROM A GASEOUS BY-PRODUCT

TECHNICAL FIELD

The present invention relates to a method for recovering hydrocarbon compounds and a hydrocarbon recovery apparatus which recover hydrocarbon compounds from gaseous by-products generated in the process of synthesizing liquid hydrocarbons by a Fisher-Tropsch synthesis reaction. This application is a divisional application of U.S. Application No. 13/138,471, filed Aug. 22, 2011, now U.S. Pat. No. 8,729,142, which is a national stage application of International Application No. PCT/JP2010/001145 filed Feb. 22, 2010, which claims priority to Japanese Patent Application No. 2009-046150, filed Feb. 27, 2009, each of which is incorporated herein by reference.

BACKGROUND ART

As one of methods for synthesizing liquid fuels from a natural gas, a GTL (Gas To Liquids: a liquid fuel synthesis) technique of reforming a natural gas to synthesize a synthesis gas containing a carbon monoxide gas (CO) and a hydrogen gas ($H_2$) as main components, synthesizing hydrocarbon compounds (FT synthesis hydrocarbons) using this synthesis gas as a feedstock gas by the Fischer-Tropsch synthesis reaction (hereinafter referred to as "FT synthesis reaction"), and further hydrogenating and fractionally distilling the hydrocarbon compounds to produce liquid fuel products, such as a naphtha (raw gasoline), a kerosene, a gas oil, and a wax, has recently been developed.

Since the liquid fuel products using the FT synthesis hydrocarbons as a feedstock have a high paraffin content, and hardly include a sulfur component, for example, as shown in Patent Document 1, the liquid fuel products attracts attention as environment-friendly fuels.

Meanwhile, in an FT synthesis reactor which performs the FT synthesis reaction, heavy FT synthesis hydrocarbons with a comparatively high carbon number is produced, and flow out as a liquid from a lower part of the FT synthesis reactor. In addition, light FT synthesis hydrocarbons with a comparatively low carbon number are generated involuntarily. The light FT synthesis hydrocarbons are discharged as gaseous by-products along with unreacted feedstock gas, from an upper part of the FT synthesis reactor.

Along with carbon dioxide, a steam, unreacted feedstock gas (carbon monoxide gas and hydrogen gas), and hydrocarbon compounds with a carbon number of 2 or less, hydrocarbon compounds with a carbon number of 3 or more which can be obtained as products (hereinafter referred to as "light FT hydrocarbons") are included in the gaseous by-products.

Thus, conventionally, the gaseous by-products are cooled down to liquefy the light FT hydrocarbons, and then the light FT hydrocarbons are separated from the other gas components by a gas-liquid separator.

CITATION LIST

Patent Document

[Patent Document 1] Japanese Patent Unexamined Publication No. 2004-323626

SUMMARY OF INVENTION

Technical Problem

Meantime, in the aforementioned gas-liquid separator, the light FT hydrocarbons which can be obtained as products are also included in the separated gas components depending on a gas-liquid equilibrium. As a result, when the amount of the light FT hydrocarbons included in the other gas component increases, the production efficiency of liquid-fuel products may be reduced.

Here, by cooling down the gaseous by-products in the gas-liquid separator to about 10° C., it is possible to liquefy a considerable part of the light FT hydrocarbons and to separate the light FT hydrocarbons from the other gas components. However, it is necessary to provide a extra cooler, and thereby the facility constitution becomes complicated. As a result, production cost of liquid-fuel products increases.

The present invention has been made in view of the aforementioned circumstances, and the object thereof is to provide a method for recovering hydrocarbon compounds and hydrocarbon compounds recovery apparatus, capable of efficiently recovering light FT hydrocarbons from gaseous by-products generated in the FT synthesis reaction, and improving the production efficiency of FT synthesis hydrocarbons, without using an extra cooler.

Solution to Problem

In order to solve the above problem and achieve such an object, the present invention suggests the following methods and apparatuses.

That is, a method of the present invention is for recovering hydrocarbon compounds from gaseous by-products generated in the Fisher-Tropsch synthesis reaction.

The method includes a pressurizing step in which the gaseous by-products are pressurized, a cooling step in which the pressurized gaseous by-products are cooled down to liquefy hydrocarbon compounds in the gaseous by-products, and a separating step in which hydrocarbon compounds liquefied in the cooling step are separated from the remaining gaseous by-products.

In the method for recovering hydrocarbon compounds of the present invention, the pressurizing step in which the gaseous by-products are pressurized is provided at the upstream of the cooling step, and thereby the pressurized gaseous by-products are cooled. Thus, it is possible to liquefy the light FT hydrocarbons, without cooling down the gaseous by-product excessively. Hence, the light FT hydrocarbons can be liquefied without using an extra cooler and the like, and the liquefied light FT hydrocarbons can be separated from the remaining gaseous by-products in the separating step. As a result, the liquid hydrocarbon compounds such as the light FT hydrocarbons can be efficiently recovered from the gaseous by-products generated in the FT synthesis reaction.

The method for recovering hydrocarbon compounds of the present invention may further includes a recycling step in which at least a portion of the remaining gaseous by-products are recycled to an FT synthesis reactor as a feedstock gas for the Fisher-Tropsch synthesis reaction.

The remaining gaseous by-products include a feedstock gas which have not contributed to a reaction in the FT synthesis reactor, that is, a carbon monoxide gas (CO) and a hydrogen gas ($H_2$). Thus, by recycling the remaining gaseous by-products to the FT synthesis reactor, the carbon monoxide gas (CO) and hydrogen gas ($H_2$) in the remaining gaseous by-products can be reused as a feedstock gas. As a result, it is possible to reduce the production cost of liquid-fuel products.

In the method for recovering hydrocarbon compounds of the present invention, the recycling step may include a pressure adjusting step in which the pressure of the portion of the remaining gaseous by-products is adjusted to the pressure in a feedstock gas inlet port of the FT synthesis reactor.

Hence, it is possible to determine the pressure of the pressurized gaseous by-products freely. That is, in the pressurizing step, it is possible to pressurize the gaseous by-products to the pressure exceeding that in the feedstock inlet port of the FT synthesis reactor. As a result, the recovery rate of the light FT hydrocarbons can be significantly improved.

A hydrocarbon recovery apparatus of the present invention is for recovering hydrocarbon compounds from gaseous by-products discharged from an FT synthesis reactor synthesizing hydrocarbon compounds by the Fisher-Tropsch synthesis reaction. The hydrocarbon recovery apparatus includes a pressurizing device which pressurizes the gaseous by-products discharged from the FT synthesis reactor, a cooler which cools down the pressurized gaseous by-products to liquefy hydrocarbon compounds in the gaseous by-products, and a gas-liquid separator which separates the hydrocarbon compounds liquefied by the cooler from the remaining gaseous by-products.

In the hydrocarbon recovery apparatus of the present invention, the gaseous by-products are pressurized by the pressurizing device, and thereafter the pressurized gaseous by-products are cooled down by the cooler to liquefy hydrocarbon compounds. Then, the liquefied hydrocarbon compounds are recovered by the gas-liquid separator. As a result, the light FT hydrocarbons can be efficiently recovered from the gaseous by-products without using an extra cooler.

The hydrocarbon recovery apparatus of the present invention may further include a recycle line for introducing at least a portion of the remaining gaseous by-products into a feedstock inlet port of the FT synthesis reactor.

Further, the recycle line may be provided with a pressure adjustor for adjusting the pressure of the remaining gaseous by-products.

Advantageous Effects of Invention

According to the present invention, it is possible to provide a method for recovering hydrocarbon compounds and hydrocarbon recovery apparatus, capable of efficiently recovering light FT hydrocarbons from gaseous by-products generated in the FT synthesis reaction, and improving the production efficiency of FT synthesis hydrocarbons, without using an extra cooler.

DESCRIPTION OF EMBODIMENTS

Hereinafter, a preferred embodiment of the present invention will be described with reference to the accompanying drawings.

First, the overall configuration and process of a liquid-fuel synthesizing system (hydrocarbon synthesis reaction system) for which a method for recovering hydrocarbon compound from gaseous by-products and a hydrocarbon recovery apparatus from gaseous by-products that are the present embodiment are used will be described with reference to FIG. 1.

Figure 1:
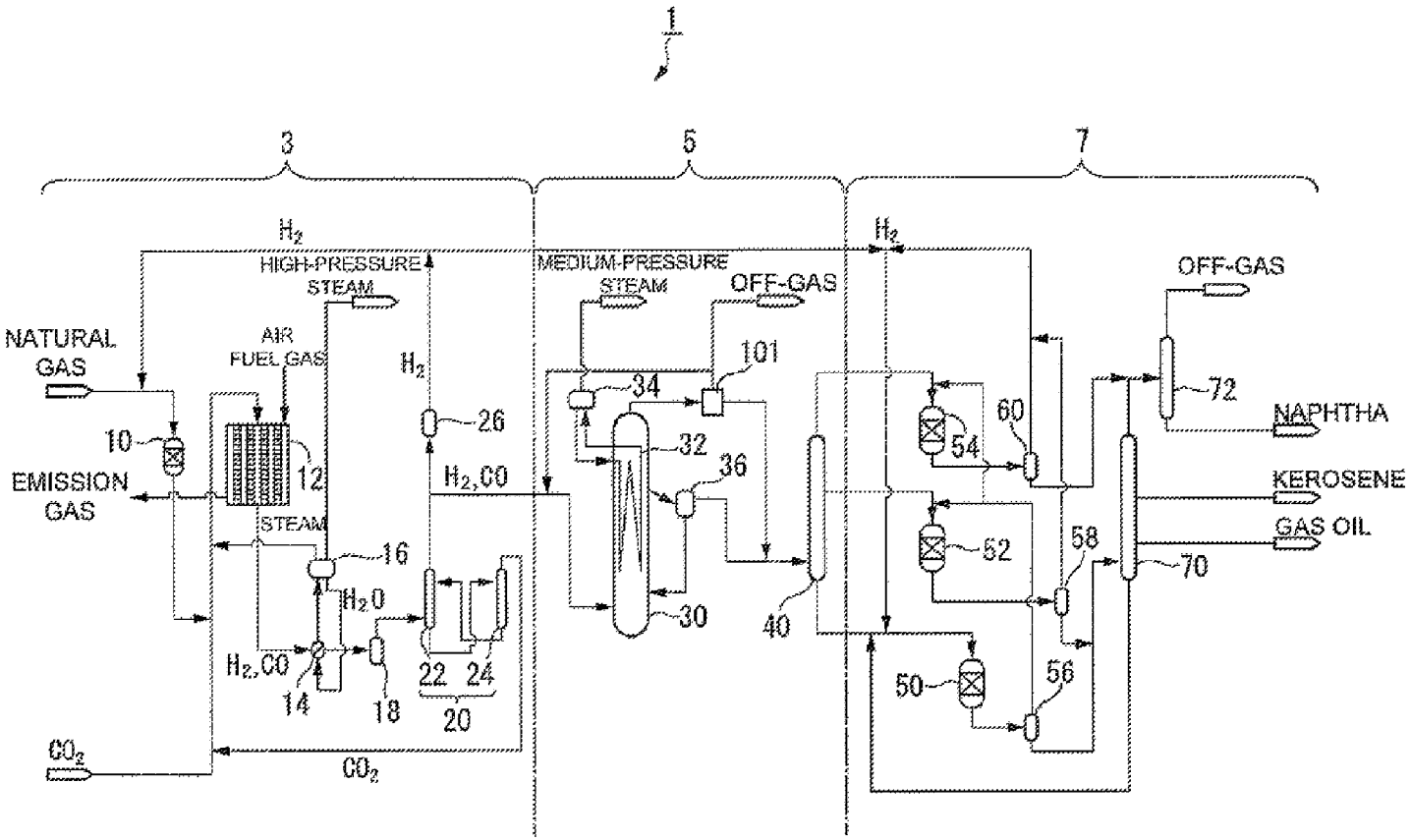
FIG. 1 is a schematic diagram showing the overall configuration of a hydrocarbon synthesizing system for which a hydrocarbon compounds recovery method and hydrocarbon recovery apparatus from the gaseous by-products according to an embodiment of the present invention are used.

As shown in FIG. 1, the liquid-fuel synthesizing system (hydrocarbon synthesis reaction system) 1 according to the present embodiment is a plant facility which carries out the GTL process which converts a hydrocarbon feedstock, such as a natural gas, into liquid fuels. This liquid-fuel synthesizing system 1 includes a synthesis gas production unit 3, an FT synthesis unit 5, and an upgrading unit 7.

The synthesis gas production unit 3 reforms a natural gas, which is a hydrocarbon feedstock, to produce a synthesis gas (a feedstock gas) including a carbon monoxide gas and a hydrogen gas.

The FT synthesis unit 5 synthesizes liquid hydrocarbons from the produced synthesis gas (a feedstock gas) by the Fischer-Tropsch synthesis reaction (hereinafter referred to as "FT synthesis reaction").

The upgrading unit 7 hydrogenates and fractionally distills the liquid hydrocarbons synthesized by the FT synthesis reaction to produce liquid fuel products (a naphtha, a kerosene, a gas oil, a wax, etc.). Hereinafter, components of these respective units will be described.

The synthesis gas production unit 3 mainly includes a desulfurization reactor 10, a reformer 12, a waste heat boiler 14, gas-liquid separators 16 and 18, a $CO_2$ removal unit 20, and a hydrogen separator 26.

The desulfurization reactor 10 is composed of, for example, a hydrodesulfurizer, and removes sulfur components from a natural gas that is a feed stock.

The reformer 12 reforms the a natural gas supplied from the desulfurization reactor 10 to produce a synthesis gas (a feedstock gas) including a carbon monoxide gas (CO) and a hydrogen gas ($H_2$) as main components.

The waste heat boiler 14 recovers waste heat of the synthesis gas produced in the reformer 12, and generates a high-pressure steam.

The gas-liquid separator 16 separates the water heated by the heat exchange with the synthesis gas in the waste heat boiler 14 into a gas (high-pressure steam) and a liquid.

The gas-liquid separator 18 removes condensed components from the synthesis gas cooled down in the waste heat boiler 14, and supplies a gas component to the $CO_2$ removal unit 20.

The $CO_2$ removal unit 20 has an absorption tower 22 which removes carbon dioxide gas by using an absorbent from the synthesis gas supplied from the gas-liquid separator 18, and a regeneration tower 24 which strips the carbon dioxide gas from the absorbent including the carbon dioxide gas, and regenerates the absorbent.

The hydrogen separator 26 separates a portion of the hydrogen gas included in the synthesis gas, from which the carbon dioxide gas has been separated in the $CO_2$ removal unit 20. It is to be noted herein that the above $CO_2$ removal unit 20 is not necessarily provided depending on circumstances.

The FT synthesis unit 5 mainly includes, for example, a bubble column reactor 30, a gas-liquid separator 34, a separator 36, a hydrocarbon recovery apparatus 101 that is the present embodiment, and a first fractionator 40.

The bubble column reactor 30, which is an example of a reactor which synthesizes liquid hydrocarbons from a synthesis gas (a gas), functions as an FT synthesis reactor which synthesizes liquid hydrocarbons from the synthesis gas by the FT synthesis reaction. The bubble column reactor 30 includes, for example, a bubble column slurry bed type reactor in which a slurry having solid catalyst particles suspended in liquid hydrocarbons (product of the FT synthesis reaction) is contained inside a column type vessel. The bubble column reactor 30 makes the carbon monoxide gas and hydrogen gas in the synthesis gas produced in the above synthesis gas production unit 3 react with each other to synthesize liquid hydrocarbons.

The gas-liquid separator 34 separates the water circulated and heated through a heat transfer pipe 32 disposed in the bubble column reactor 30 into a steam (medium-pressure steam) and a liquid.

The separator 36 separates the liquid hydrocarbons and catalyst particles in the slurry contained inside the bubble column reactor 30.

The hydrocarbon recovery apparatus 101 is connected to the top of the bubble column reactor 30, cools down discharged gaseous by-products, and recovers hydrocarbons (light FT hydrocarbons) with a carbon number of 3 or more.

The first fractionator 40 fractionally distills the liquid hydrocarbons supplied from the bubble column reactor 30 via the separator 36 and the hydrocarbon recovery apparatus 101.

The upgrading unit 7 includes, for example, a wax fraction hydrocracking reactor 50, a middle distillate hydrotreating reactor 52, a naphtha fraction hydrotreating reactor 54, gas-liquid separators 56, 58, and 60, a second fractionator 70, and a naphtha stabilizer 72.

The wax fraction hydrocracking reactor 50 is connected to the bottom of the first fractionator 40, and has the gas-liquid separator 56 provided at the downstream thereof.

The middle distillate hydrotreating reactor 52 is connected to a middle part of the first fractionator 40, and has the gas-liquid separator 58 provided at the downstream thereof.

The naphtha fraction hydrotreating reactor 54 is connected to the top of the first fractionator 40, and has the gas-liquid separator 60 provided at the downstream thereof.

The second fractionator 70 fractionally distills the liquid hydrocarbons supplied from the gas-liquid separators 56 and 58.

The naphtha stabilizer 72 further rectifies the liquid hydrocarbons of the naphtha fraction supplied from the gas-liquid separator 60 and the second fractionator 70, to discharge a light component as an off-gas and separate and recover a heavy component as a naphtha product.

Next, a process (GTL process) of synthesizing liquid fuels from a natural gas by the liquid-fuel synthesizing system 1 configured as above will be described.

A natural gas (whose main component is $CH_4$) as a hydrocarbon feedstock is supplied to the liquid-fuel synthesizing system 1 from an external natural gas supply source (not shown), such as a natural gas field or a natural gas plant. The above synthesis gas production unit 3 reforms this natural gas to produce synthesis gas (mixed gas including a carbon monoxide gas and a hydrogen gas as main components).

First, the above natural gas is supplied to the desulfurization reactor 10 along with the hydrogen gas separated by the hydrogen separator 26. The desulfurization reactor 10 converts sulfur components included in the natural gas into hydrogen sulfide by the action of a hydrodesulfurization catalyst using the hydrogen gas, and adsorbs and removes the produced hydrogen sulfide by, for example, ZnO.

The desulfurized natural gas is supplied to the reformer 12 after the carbon dioxide ($CO_2$) gas supplied from a carbon-dioxide supply source (not shown) and the steam generated in the waste heat boiler 14 are mixed together. The reformer 12 reforms a natural gas by using a carbon dioxide and a steam to produce high-temperature synthesis gas including a carbon monoxide gas and a hydrogen gas as main components, by the steam and carbon-dioxide-gas reforming method.

The high-temperature synthesis gas (for example, 900° C., 2.0 MPaG) produced in the reformer 12 in this way is supplied to the waste heat boiler 14, and is cooled down (for example, to 400° C.) by the heat exchange with the water which circulates through the waste heat boiler 14, thereby recovering the exhausted heat.

The synthesis gas cooled down in the waste heat boiler 14 is supplied to the absorption tower 22 of the $CO_2$ removal unit 20, or the bubble column reactor 30, after condensed components are separated and removed in the gas-liquid separator 18. The absorption tower 22 absorbs carbon dioxide gas included in the synthesis gas with the contained absorbent, to separate the carbon dioxide gas from the synthesis gas. The absorbent including the carbon dioxide gas within this absorption tower 22 is introduced into the regeneration tower 24, the absorbent including the carbon dioxide gas is heated and subjected to stripping treatment with, for example, a steam, and the resulting diffused carbon dioxide gas is delivered to the reformer 12 from the regeneration tower 24, and is reused for the above reforming reaction.

The synthesis gas produced in the synthesis gas production unit 3 in this way is supplied to the bubble column reactor 30 of the above FT synthesis unit 5. At this time, the composition ratio of the synthesis gas supplied to the bubble column reactor 30 is adjusted to a composition ratio (for example, $H_2$:CO=2:1 (molar ratio)) suitable for the FT synthesis reaction.

Additionally, the hydrogen separator 26 separates the hydrogen gas included in the synthesis gas, by the adsorption and desorption (hydrogen PSA) using a pressure difference. This separated hydrogen gas is continuously supplied from a gas holder (not shown), via a compressor (not shown) to various hydrogen-utilizing reaction devices (for example, the desulfurization reactor 10, the wax fraction hydrocracking reactor 50, the middle distillate hydrotreating reactor 52, the naphtha fraction hydrotreating reactor 54, and so on) which perform predetermined reactions utilizing hydrogen gas within the liquid-fuel synthesizing system 1.

Next, the above FT synthesis unit 5 synthesizes liquid hydrocarbons by the FT synthesis reaction from the synthesis gas produced in the above synthesis gas production unit 3.

The synthesis gas produced in the above synthesis gas production unit 3 flows into the bottom of the bubble column reactor 30, and rises through the slurry contained in the bubble column reactor 30. At this time, within the bubble column reactor 30, the carbon monoxide gas and hydrogen gas which are included in the synthesis gas react with each other by the aforementioned FT synthesis reaction, thereby producing hydrocarbon compounds.

The liquid hydrocarbon compounds synthesized in the bubble column reactor 30 are introduced into the separator 36 along with catalyst particles as a slurry.

The separator 36 separates the slurry into a solid component, such as catalyst particles, and a liquid component including liquid hydrocarbon compounds. A portion of the separated solid component, such as the separated catalyst particles, is returned to the bubble column reactor 30, and a liquid component is supplied to the first fractionator 40.

Additionally, gaseous by-products including the unreacted synthesis gas (feedstock gas) and the generated gaseous hydrocarbon compounds are discharged from the top of the bubble column reactor 30, and are supplied to the hydrocarbon recovery apparatus 101 that is the present embodiment. The hydrocarbon recovery apparatus 101 cools down the gaseous by-products to separate condensed liquid hydrocarbon compounds (light FT hydrocarbons), and introduces the liquid hydrocarbon compounds into the first fractionator 40. Meanwhile, the remaining gaseous by-products separated from the liquid hydrocarbon compounds in the hydrocarbon recovery apparatus 101 include the unreacted synthesis gas (CO and $H_2$) and hydrocarbon compounds with a carbon number of 2 or less as main components, and the remaining gaseous by-products are introduced into the bottom of the bubble column reactor 30 again, and are reused for the FT synthesis reaction. Additionally, a portion of the remaining gaseous by-products which have not been reused for the FT synthesis reaction are discharged as an off-gas, and are used as a fuel gas, are recovered as a fuel equivalent to LPG (Liquefied Petroleum Gas), or are reused as the feedstock of the reformer 12 of the synthesis gas production unit.

Next, the first fractionator 40 fractionally distills the liquid hydrocarbon compounds, which are supplied from the bubble column reactor 30 via the separator 36 and the hydrocarbon recovery apparatus 101 as described above, into a naphtha fraction (whose boiling point is lower than about 150° C.), a middle distillate equivalent to a kerosene and a gas oil (whose boiling point is about 150 to 350° C.), and a wax fraction (whose boiling point exceeds about 350° C.).

The liquid hydrocarbon compounds as the wax fraction (mainly $C_{21}$ or more) drawn from the bottom of the first fractionator 40 are brought to the wax fraction hydrocracking reactor 50, the liquid hydrocarbon compounds as the middle distillate (mainly $C_{11}$ to $C_{20}$) drawn from the middle part of the first fractionator 40 are brought to the middle distillate hydrotreating reactor 52, and the liquid hydrocarbon compounds as the naphtha fraction (mainly $C_5$ to $C_{10}$) drawn from the top of the first fractionator 40 are brought to the naphtha fraction hydrotreating reactor 54.

The wax fraction hydrocracking reactor 50 hydrocracks the liquid hydrocarbon compounds as the wax fraction (approximately $C_{21}$ or more), which has been drawn from the bottom of the first fractionator 40, by using the hydrogen gas supplied from the above hydrogen separator 26, to reduce the carbon number to $C_{20}$ or less. In this hydrocracking reaction, hydrocarbon compounds with a small carbon number are produced by cleaving C—C bonds of hydrocarbon compounds with a large carbon number, using a catalyst and heat. A product including the liquid hydrocarbon compounds hydrocracked in this wax fraction hydrocracking reactor 50 is separated into a gas and a liquid in the gas-liquid separator 56, the liquid hydrocarbon compounds of which are brought to the second fractionator 70, and the gas component of which (including a hydrogen gas) is brought to the middle distillate hydrotreating reactor 52 and the naphtha fraction hydrotreating reactor 54.

The middle distillate hydrotreating reactor 52 hydrotreats liquid hydrocarbon compounds as the middle distillate with a middle carbon number (approximately $C_{11}$ to $C_{20}$), which have been drawn from the middle part of the first fractionator 40, by using the hydrogen gas supplied from the hydrogen separator 26 via the wax fraction hydrocracking reactor 50. In this hydrotreating, hydrogenation of olefins which are generated as by-products in the FT synthesis reaction, conversion of oxygen-containing compounds, such as alcohols which are also by-products in the FT synthesis reaction, into paraffins by hydrodeoxygenation, and hydroisomerization of normal paraffins into isoparaffins proceed.

A product including the hydrotreated liquid hydrocarbon compounds is separated into a gas and a liquid in the gas-liquid separator 58, the liquid hydrocarbon compounds of which are brought to the second fractionator 70, and the gas component of which (including a hydrogen gas) is reused for the above hydrogenation reactions.

The naphtha fraction hydrotreating reactor 54 hydrotreats liquid hydrocarbon compounds as the naphtha fraction with a low carbon number (approximately $C_{10}$ or less), which have been drawn from the top of the first fractionator 40, by using the hydrogen gas supplied from the hydrogen separator 26 via the wax fraction hydrocracking reactor 50. A product including the hydrotreated liquid hydrocarbon compounds is separated into a gas and a liquid in the gas-liquid separator 60, the liquid hydrocarbon compounds of which are brought to the naphtha stabilizer 72, and the gas component of which (including a hydrogen gas) is reused for the above hydrogenation reaction.

Next, the second fractionator 70 fractionally distills the liquid hydrocarbon compounds, which are supplied from the wax fraction hydrocracking reactor 50 and the middle distillate hydrotreating reactor 52 as described above, into hydrocarbon compounds with a carbon number of $C_{10}$ or less (whose boiling point is lower than about 150° C.), a kerosene (whose boiling point is about 150 to 250° C.), a gas oil (whose boiling point is about 250 to 350° C.), and an uncracked wax fraction (whose boiling point is higher than 350° C.) from the wax fraction hydrocracking reactor 56. The uncracked wax fraction is obtained from the bottom of the second fractionator 70, and this is recycled to the upstream of the wax fraction hydrocracking reactor 50. A kerosene and a gas oil are drawn from the middle part of the second fractionator 70. Meanwhile, hydrocarbon compounds of $C_{10}$ or less is drawn from the top of the second fractionator 70, and is supplied to the naphtha stabilizer 72.

Moreover, the naphtha stabilizer 72 distills the hydrocarbon compounds of $C_{10}$ or less, which have been supplied from the above naphtha fraction hydrotreating reactor 54 and second fractionator 70, and thereby, obtains naphtha ($C_5$ to $C_{10}$) as a product. Accordingly, a high-purity naphtha is drawn from the bottom of the naphtha stabilizer 72. Meanwhile, an off-gas other than target products, including hydrocarbon compounds with a carbon number that is equal to or less than a predetermined number as a main component, is discharged from the top of the naphtha stabilizer 72. This off-gas is used as a fuel gas, or is recovered as a fuel equivalent to LPG.

The process (GTL process) of the liquid-fuel synthesizing system 1 has been described hitherto. By the GTL process concerned, a natural gas is converted into liquid fuels, such as a high-purity naphtha ($C_5$ to $C_{10}$), a kerosene ($C_{11}$ to $C_{15}$), and a gas oil ($C_{16}$ to $C_{20}$).

Figure 2:
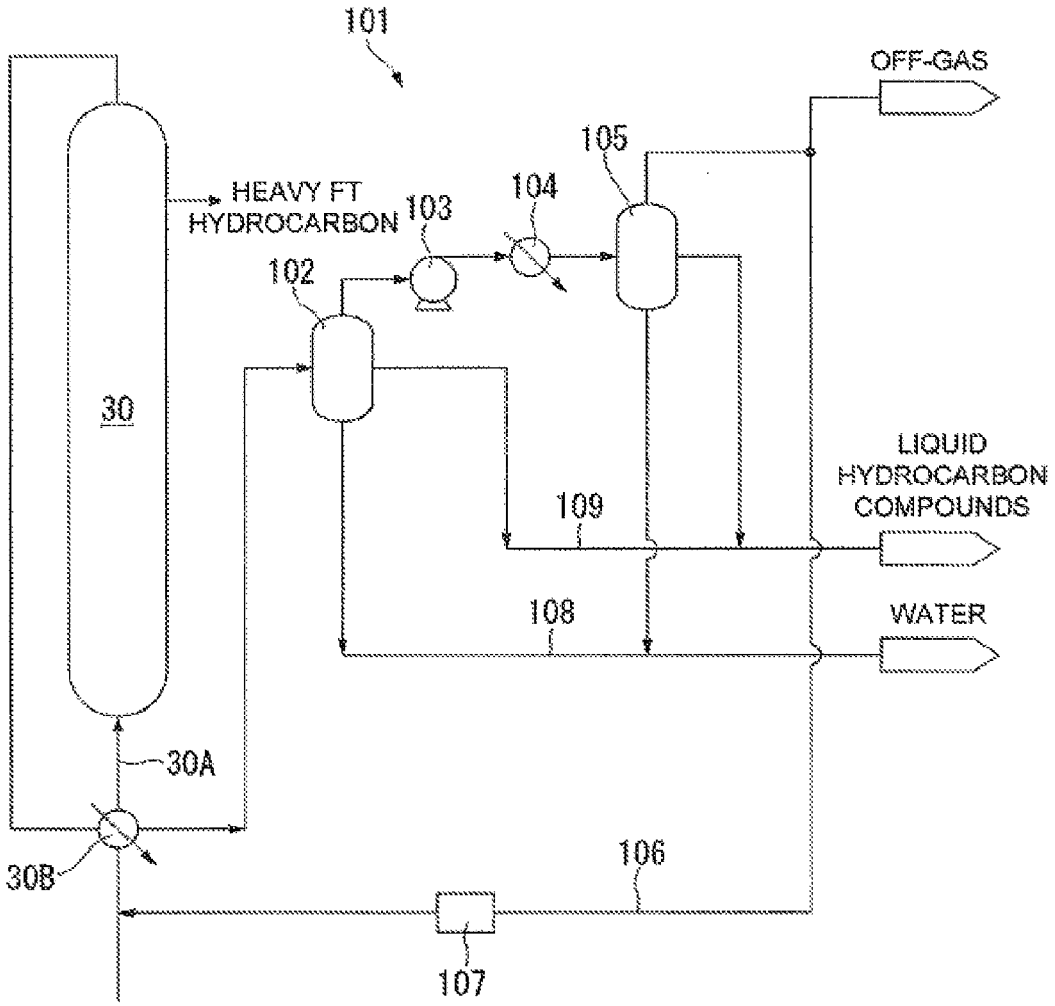
FIG. 2 is an explanatory view showing the periphery of the hydrocarbon recovery apparatus from the gaseous by-products according to the embodiment of the present invention.
Figure 3:
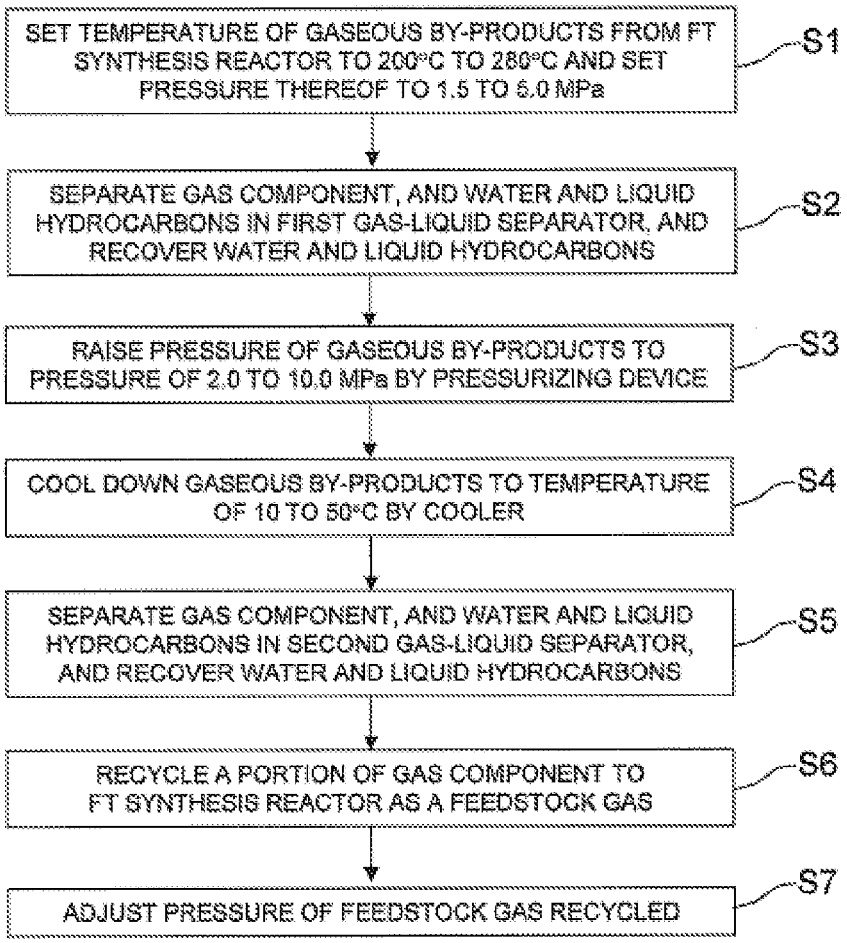
FIG. 3 is a flow chart showing the method for recovering hydrocarbon compounds from the gaseous by-products according to the embodiment of the present invention.

Next, the configuration and operation of the periphery of the hydrocarbon recovery apparatus 101 that is the present embodiment will be described in detail with reference to FIGS. 2 and 3.

This hydrocarbon recovery apparatus 101 includes a first gas-liquid separator 102 which separates the by-products discharged from the top of the bubble column reactor (FT synthesis reactor) 30 into a liquid component and gaseous by-products, a pressurizing device 103 which pressurizes the gaseous by-products separated by the first gas-liquid separator 102 from the by-product, a cooler 104 which cools down the pressurized gaseous by-products, and a second gas-liquid separator 105 that separates the cooled gaseous by-products into a liquid component and remaining gaseous by-products, and a recycle line 106 which recycles the remaining gaseous by-products separated from the cooled gaseous by-products in the second gas-liquid separator 105 to a feedstock inlet 30A of the bubble column reactor 30 as a feedstock gas. In addition, the recycle line 106 is provided with a pressure adjustor 107 for adjusting the pressure of the recycled remaining gaseous by-products.

First, by-products in the FT synthesis reaction are discharged from the top of the bubble column reactor 30 (a by-product discharging step S1). These by-products, after passing through a heat exchanger 30B provided at the upstream of the feedstock inlet 30A of the bubble column reactor 30, are introduced into the first gas-liquid separator 102 where a liquid component (water and liquid hydrocarbon compounds) and gaseous by-products are separated (a first separating step S2). The water and liquid hydrocarbon compounds which have been separated in the first gas-liquid separator 102 are recovered via recovery lines 108 and 109, respectively.

Meanwhile, heavy FT hydrocarbons flowing out as a liquid from the bubble column reactor 30 is introduced into the aforementioned separator 36.

Here, the temperature T1 of the gaseous by-products in the by-product discharging step S1 is set to 200° C.≤T1≤280° C., and the pressure P1 is set to 1.5 MPa≤P1≤5.0 MPa.

These gaseous by-products from which a liquid component has been separated in the first gas-liquid separator 102 are pressurized by the pressurizing device 103 (a pressurizing step S3).

In this pressurizing step S3, it is preferable to raise the pressure so that the pressure P3 of the gaseous by-products satisfies P1+0.5 MPa≤P3 ≤P1+5.0 MPa with respect to the pressure P1 of the by-products discharged from the top of the bubble column reactor 30.

The gaseous by-products pressurized in this way are cooled by the cooler 104 (a cooling step S4). The temperature T4 of the gaseous by-products is set to 10° C.≤T4≤50° C. by this cooling step S4. In addition, this cooler 104 does not have an extraordinary cooling mechanism but is a heat exchanger using industrial water. Additionally, the temperature T4 is determined by the temperature of the industrial water obtained in the circumstances where the present invention is implemented.

The cooled gaseous by-products are introduced into the second gas-liquid separator 105, and the liquid component (water and liquid hydrocarbon compounds) is separated from the gaseous by-products (a second separating step S5). In this second gas-liquid separator 105, depressurization is not performed in order to maintain a gas-liquid equilibrium state in the cooling step S4. Also, the water and liquid hydrocarbon compounds (light FT hydrocarbons) which have been separated in this second gas-liquid separator 105 are recovered via the recovery lines 108 and 109, respectively.

Meanwhile, the remaining gaseous by-products which have been separated in the second gas-liquid separator 105 include the unreacted synthesis gases (CO and $H_2$) and hydrocarbon compounds with a carbon number of 2 or less as main components, and a portion of the remaining gaseous by-products are recycled to the feedstock inlet 30A of the bubble column reactor 30 via the recycle line 106 as a feedstock gas (a recycling step S6). Additionally, the remaining gaseous by-products which have not recycled to the FT synthesis reaction are introduced into an external combustion facility (not shown) as an off-gas (a flare gas), are combusted therein, and are discharged into the atmosphere.

At this time, the pressure of the remaining gaseous by-products which have been recycled is adjusted to the pressure in the feedstock inlet P7 by the pressure adjustor 107 provided in the recycle line 106 (a pressure adjusting step S7). Specifically, the pressure in the feedstock inlet P7 is set to 1.5 MPa≤P7≤5.0 MPa, and the remaining gaseous by-products pressurized by the pressurizing device 103 are depressurized by the pressure adjustor 107.

In this way, hydrocarbon compounds with a carbon numbers of 3 or more (light FT hydrocarbons) are recovered from the gaseous by-products which have been generated in the bubble column reactor 30.

According to the hydrocarbon recovery device 101 from the gaseous by-products and the method for recovering hydrocarbon compounds using this hydrocarbon recovery device 101, which are the present embodiment having the above-described configuration, since the pressurizing step S3 in which the gaseous by-products are pressurized is provided at the upstream of the cooling step S4, the light FT hydrocarbons can be liquefied and recovered, without cooling down the gaseous by-products in the cooling step S4 excessively. Accordingly, it is unnecessary to use an extra cooler, and a cost for recovering the light FT hydrocarbons from the gaseous by-products can be suppressed.

Additionally, in the recycling step S6 of the present embodiment, the remaining gaseous by-products separated in the second gas-liquid separator 105 is recycled to the feedstock inlet 30A of the bubble column reactor 30 via the recycle line 106 as a feedstock gas. Thus, it is possible to reuse the unreacted feedstock gas (a carbon monoxide gas and a hydrogen gas) discharged from the bubble column reactor 30.

Moreover, the present embodiment is provided with the pressure adjusting step S7 in which the pressure of the recycled remaining gaseous by-products is adjusted to that in the feedstock gas inlet 30A by the pressure adjustor 107 equipped on the recycle line 106. Hence, it is possible to determine the pressure of the pressurized gaseous by-products freely. That is, it is possible to pressurize the gaseous by-products to the pressure exceeding that in the feedstock inlet 30A, P7, in the pressurizing step S3. As a result, it is possible to significantly improve the recovery rate of the light FT hydrocarbons from the gaseous by-products discharged from the top of the bubble column reactor 30.

Additionally, since the first gas-liquid separator 102 (the first separating step S2) is provided at the upstream of the cooler 104 (the cooling step S4), if a liquid component (water and hydrocarbon compounds with a relatively large carbon number) is included in the by-product discharged from the top of the bubble column reactor 30, the first gas-liquid separator 102 (the first separating step S2) can recover the liquid component in advance.

Moreover, in the present embodiment, the pressure P3 of the gaseous by-product is raised using the pressurizing device 103 in the a pressurizing step S3 so as to be P3≥P1+0.5 MPa with respect to the pressure P1 of the by-products discharged from the bubble column reactor 30. Thus, light FT hydrocarbons can be efficiently recovered by cooling down the gaseous by-products to about, for example, 10 to 50° C. in the cooling step S4.

Additionally, the pressure P3 of the gaseous by-product is raised using the pressurizing device 103 in the pressurizing step S3 so as to be P3≤P1+5.0 MPa with respect to the pressure P1 of the by-product discharged from the bubble column reactor 30. Thus, it is possible to use an ordinary pressurizing device, and a cost escalation accompanying the recovery of the light FT hydrocarbons can be suppressed. In addition, since a larger pressurizing device is needed if P3>P1+5.0 MPa, this is not preferable.

Although the embodiment of the present invention has been described hitherto in detail with reference to the drawings, concrete configurations are not limited to the embodiment, and the invention also includes design changes which do not depart from the spirit of the present invention.

For example, although the case where the first gas-liquid separator and the second gas-liquid separator are provided has been described, the present invention is not limited to this, and the number of gas-liquid separators may be one, and three or more gas-liquid separators may be provided.

Additionally, although the case where the pressurizing device is arranged at the downstream of the first gas-liquid separator has been described, the present invention is not limited to this, and any arrangements may be adopted unless it is provided at the upstream of the cooler Moreover, the configurations of the synthesis gas production unit 3, FT synthesis unit 5, and upgrading unit 7 are not limited to those described in the present embodiment, and any arbitrary configurations in which the gaseous by-products are introduced into the hydrocarbon compound recovery device may be adopted.

[Embodiments]

The results of a confirmation experiment conducted to confirm the effects of the present invention will be described below. As conventional examples, the gaseous by-products discharged from the top of a bubble column reactor were cooled while keeping the pressure at discharge, P1 (=3 MPa), and were separated into a liquid component consisting of water and liquid hydrocarbon compounds, and remaining gaseous by-products in the gas-liquid separator. Here, Conventional Examples 1 to 3 were adopted in which the temperatures of the gaseous by-products in the gas-liquid separator were changed from 20° C., to 30° C., and 45° C., respectively.

As examples of the present invention, the pressure of the gaseous by-products discharged from the top of a bubble column reactor were raised so as to be higher than the pressure at discharge, P1 (=3 MPa), by the pressurizing device. After that, the pressurized gaseous by-products were cooled down, and were separated into a liquid component consisting of water and liquid hydrocarbon compounds and remaining gaseous by-products in a gas-liquid separator. Here, Examples 1 to 9 of the present invention were adopted in which the pressures and temperatures of the remaining gaseous by-products were adjusted in the gas-liquid separator.

Also, the recovery amounts of hydrocarbon compounds recovered in the gas-liquid separator, and the residual amounts of hydrocarbon compounds with a carbon number of 3 or more included in the remaining gaseous by-products separated in the gas-liquid separator were measured. In addition, the recovery amount and residual amount in each of Examples 1 to 9 of the present invention were expressed in the increase-decrease rate based on the reference amount (±0%), which is the recovery amount and residual amount in the Conventional Example conducted at the same temperature as that in the said Example of the present invention. The results are shown in Table 1.

TABLE 1

| | Temperature | Pressure | Recovery Amount*1 | Residual Amount*2 |
|---|---|---|---|---|
| Conventional Example 1 | 20° C. | 3.0 MPa | Reference Amount | Reference Amount |
| Example 1 of Invention | | 3.5 MPa | +2.39% | −1.32% |
| Example 2 of Invention | | 4.5 MPa | +5.71% | −3.16% |
| Example 3 of Invention | | 5.5 MPa | +7.64% | −4.23% |
| Conventional Example 2 | 30° C. | 3.0 MPa | Reference Amount | Reference Amount |
| Example 4 of Invention | | 3.5 MPa | +2.69% | −1.23% |
| Example 5 of Invention | | 4.5 MPa | +6.46% | −2.94% |
| Example 6 of Invention | | 5.5 MPa | +8.70% | −3.96% |
| Conventional Example 3 | 45° C. | 3.0 MPa | Reference Amount | Reference Amount |
| Example 7 of Invention | | 3.5 MPa | +2.95% | −1.01% |
| Example 8 of Invention | | 4.5 MPa | +7.23% | −2.47% |
| Example 9 of Invention | | 5.5 MPa | +9.89% | −3.37% |

*1Recovery Amount: Recovery amount of liquid hydrocarbon compounds from gaseous by-products

*2Residual Amount: Residual Amount of hydrocarbon compounds with a carbon number of 3 or more included in the remaining gaseous-by products In the respective temperature conditions, it was confirmed that, the higher the pressure of the gaseous by-products in the gas-liquid separator is, the more the recovery amount of the liquid hydrocarbon compounds becomes, and the less the residual amount of the hydrocarbon compounds with a carbon number of 3 or more in the remaining gaseous by-products decreases. That is, it was confirmed that the recovering efficiency of hydrocarbon compounds is significantly improved by cooling down in a state where the pressure is raised.

INDUSTRIAL APPLICABILITY

According to the method for recovering hydrocarbon compounds and hydrocarbon recovery device of the present invention, without an extra cooler, light FT hydrocarbons can be efficiently recovered from the gaseous by-products in the FT synthesis reaction, and the production efficiency of FT synthesis hydrocarbons can be improved.

DESCRIPTION OF REFERENCE NUMERALS

30: A BUBBLE COLUMN REACTOR (A BUBBLE COLUMN TYPE HYDROCARBON SYNTHESIS REACTOR)
101: HYDROCARBON COMPOUND RECOVERY APPARATUS
103: PRESSURIZING DEVICE
104: COOLER
105: SECOND VAPOR-LIQUID SEPARATOR (VAPOR-LIQUID SEPARATOR)
106: RECYCLE LINE
107: PRESSURE ADJUSTOR

The invention claimed is:

1. A hydrocarbon recovery apparatus for recovering hydrocarbon compounds from first gaseous by-products discharged from an FT synthesis reactor for producing hydrocarbon compounds by the Fisher-Tropsch synthesis reaction, the apparatus comprising:

a heat exchanger provided at the upstream of a feedstock gas inlet port of the FT synthesis reactor;

a first gas-liquid separator configured to separate the first gaseous by-products discharged from the top of the FT synthesis reactor into a liquid component and second gaseous by-products;

a pressurizing device configured to pressurize the second gaseous by-products so that a pressure value P3 of the pressurized second gaseous by-products satisfies $P1+0.5MPa \leq P3 \leq P1+5.0$ MPa with respect to a pressure value P1 of the first gaseous by-products;

a cooler configured to cool down the pressurized second gaseous by-products to liquefied hydrocarbon compounds from the cooled second gaseous by-products;

a second gas-liquid separator configured to separate a liquid component including the liquefied hydrocarbon compounds from the cooled second gaseous by-products by the cooler; and a recycle line for introducing at least a portion of the remaining gaseous by-products which is separated the liquid component from the second gaseous by-products in the second gas-liquid separator into the feedstock gas inlet port of the FT synthesis reactor through the heat exchanger as a feedstock gas, wherein, the first gaseous by-products discharged from the top of the FT synthesis reactor are passed through the heat exchanger and are introduced into the first gas-liquid separator, and the recycle line is provided with a pressure adjustor for adjusting the pressure of the remaining gaseous by-products to the internal pressure of the feedstock inlet port.

* * * * *